United States Patent [19]

Chutter

[11] 4,232,977

[45] Nov. 11, 1980

[54] PACKAGE FOR ANTIPERSPIRANT/DEODORANT

[75] Inventor: Raymond A. Chutter, Cincinnati, Ohio

[73] Assignee: The Procter & Gamble Company, Cincinnati, Ohio

[21] Appl. No.: 952,357

[22] Filed: Oct. 18, 1978

[51] Int. Cl.[3] ..... A45D 40/04

[52] U.S. Cl. ..... 401/68; 401/69; 401/82; 401/87; 401/172

[58] Field of Search ..... 401/61, 68–79, 401/82–84, 87, 116, 172–174, 175; 222/390

[56] References Cited

U.S. PATENT DOCUMENTS

| | | | |
|---|---|---|---|
| 1,538,225 | 5/1925 | Stockseth | 401/175 |
| 1,568,178 | 1/1926 | Noble | 401/78 |
| 1,909,146 | 5/1933 | Bohanan | 401/174 |
| 2,284,218 | 5/1942 | Livingston | 222/390 X |
| 2,370,626 | 3/1945 | Heideman | 401/174 X |
| 2,491,724 | 12/1949 | Gelardin | 401/79 |
| 2,573,828 | 11/1951 | Braselton | 401/75 X |
| 2,815,122 | 12/1957 | Lerner et al. | 401/61 |
| 2,815,123 | 12/1957 | Safianoff | 401/70 X |
| 2,818,167 | 12/1957 | McKinley | 401/75 |
| 2,917,765 | 12/1959 | Jakubowski | 401/175 |
| 3,333,740 | 8/1967 | Waller | 401/61 X |
| 3,420,417 | 1/1969 | Kardel | 222/390 |

FOREIGN PATENT DOCUMENTS

| | | | |
|---|---|---|---|
| 557384 | 5/1957 | Belgium | 401/79 |
| 1813437 | 7/1969 | Fed. Rep. of Germany | 401/78 |
| 723535 | 4/1932 | France | 222/390 |
| 928223 | 11/1947 | France | 401/69 |
| 934221 | 5/1948 | France | 401/172 |
| 1034682 | 7/1953 | France | 401/175 |
| 1045189 | 11/1953 | France | 401/79 |
| 1098701 | 8/1955 | France | 401/69 |
| 413680 | 5/1946 | Italy | 222/390 |
| 12013 | 5/1921 | United Kingdom | 401/174 |

*Primary Examiner*—Steven A. Bratlie

*Attorney, Agent, or Firm*—John V. Gorman; Richard C. Witte; Thomas H. O'Flaherty

[57] ABSTRACT

A package is disclosed for a stick antiperspirant and/or deodorant product with the package comprising an imperforate elevator platform for carrying the product and slidably disposed within the bore of a tubular sleeve, a handwheel rotatably carried at one end of the sleeve or body and having an elevating screw fixed thereon for rotation with the handwheel and cooperating with a threaded stem depending from the elevating platform. The upper portion of the sleeve bore has lengthwise extending chordal flats provided thereon, the intermediate portion of the bore is a smooth, generally cylindrical sealing surface and its lower portion is unobstructed. The platform has a depending peripheral skirt the upper part of which has lugs to coact with the chordal flats to prevent relative rotation of the platform and sleeve and the lower port of which is adapted to form a seal with the intermediate portion of the sleeve bore when the platform is in its lowermost position.

2 Claims, 7 Drawing Figures

PACKAGE FOR ANTIPERSPIRANT/DEODORANT

TECHNICAL FIELD

This invention relates to packaging of stick form products which contain a volatile component and, more particularly, to a vapor tight package of molded plastic for stick type antiperspirant and/or deodorant products.

BACKGROUND ART

Dispensing packages for stick type medications, cosmetics, deodorants, antiperspirants and the like have been in use for many years. Many of such packages have employed elevating mechanisms designed to advance the product outwardly from a protective sleeve to a position wherein the user is able to apply the product in its intended manner. As shown in U.S. Pat. No. 2,818,167, which issued to W. E. McKinley on Dec. 31, 1957, one such mechanism can comprise a handwheel mounted for rotation on the end of the sleeve and having a threaded stem which projects through and is in threaded engagement with a threaded central aperture of a pusher or elevating member disposed within the sleeve and supporting the product. Similar types of elevating or dispensing arrangements are also shown in U.S. Pat. No. 2,573,828, which issued to C. H. Braselton on Nov. 6, 1951 and in U.S. Pat. No. 2,284,218, issued to J. K. Livingston on May 26, 1942.

In such packages, however, the projection of the threaded stem into the product causes an appearance problem with stick type products. In this connection, after the stick has been partially used a central hole (or, if the material is soft, an unattractive depression) appears in the applicating surface. Moreover, such packages which contain products with volatile components provide problems in sealing against leakage between the stem and the elevating member.

One approach to the solution of the appearance problem is to prevent the stem from extending through the elevating member. This is shown, for example, in U.S. Pat. No. 2,815,122, issued Dec. 3, 1957 to L. L. Lerner et al., wherein the threaded means to raise the elevator is located entirely underneath the elevating member. A similar structure is shown in U.S. Pat. No. 2,815,123, issued on Dec. 3, 1957 to A. Safianoff. In the Lerner et al. device the package is said to be sealed by an elongated cap which telescopes over the sleeve and frictionally engages the lower portion thereof. Since this overall seal involves at least four surfaces which have to be pressed into intimate contact to be effective, it will be readily seen that very close molding tolerances would have to be maintained, an elongated cap is essential and that the cap would have to fit tightly enough that removal would be difficult.

In the above-cited McKinley patent, the sealing problem at the lower end of the dispenser is purported to be effected in two locations, i.e. one being between the portion of lower surface of the elevator which surrounds the central aperture and an annular ridge on the stem and the other being between the periphery of the lower surface of the elevator and the periphery of the end wall of the sleeve. The seals are to be simultaneously effected by turning the handwheel so as to force the elevator downwardly into the described dual sealing arrangement. This requires a very flexible elevator, requires very close molding tolerances and prevents quick and non-critical bottom assembly of the elevator within the sleeve. The upper seal of the McKinley dispenser is achieved by means of a short cap which is threadedly engaged with the applicating end of the sleeve.

Another problem in connection with stick dispensers using screw type elevating mechanisms is that of preventing relative rotation between the elevator and the sleeve since this would result in the elevator merely rotating in position when the handwheel is turned, thus failing to advance or retract the stick. In the cited McKinley patent this was accomplished by providing ribs full length along the bore of the sleeve and mating notches on the elevator. A similar system is mentioned in U.S. Pat. No. 3,420,417, issued to J. V. Kardel on Jan. 7, 1969 with reference to a dispenser using a screw-actuated piston.

The aforementioned Lerner et al. dispenser, on the other hand, employs a elevator of polygonal cross section and a plurality of mating flats on the portion of the bore of the sleeve housing the elevator in its entirety during movement from its lowermost to uppermost positions. In the cited Livingston patent, one embodiment shows a container of polygonal cross section and a mating piston to prevent rotation. Livingston also shows the use of paper or cellophane washer having a downturned flange fitting between the piston periphery and container side walls to prevent leakage of a paste product. It is apparent, however, that such a structure cannot establish a vapor seal about the piston in a commercially feasible manner.

It is an object of the present invention to provide in a dispenser for stick types of products an arrangement of components which obviates the above described problems.

It is another object of the present invention to provide such a dispenser which can be adapted for use with either "tall" caps (i.e. enveloping the sleeve and forming an overall package seal by engagement with the lower portion of the package) or, optionally, with "short" caps (i.e. sealing only the applicating end of the sleeve).

It is a further object of the present invention to provide such a dispenser which is economical to produce, visually attractive, capable of high speed assembly and loading and which will protect its contents from degradation during long term storage.

DISCLOSURE OF INVENTION

In accordance with the present invention there is provided an elevating package for a stick form product containing a volatile component. The package comprises an elongated sleeve, an elevating platform and a handwheel. The sleeve is constructed of molded plastic and has a through bore, the upper portion of which has a chordal surface extending throughout its length, the intermediate portion of which is a smooth, generally cylindrical sealing surface and the lower portion of which is unobstructed and terminates at the open lower end of the bore. The elevating platform is made of molded plastic and is slidably disposed within the sleeve bore, being adapted to be moved from a lowermost position to an uppermost position within the sleeve. The platform has an imperforate product-support surface of generally circular conformation and a depending peripheral skirt. The upper part of the skirt is provided with lugs designed to coact with the chordal surface of the upper portion of the sleeve bore to prevent relative rotation between the two. The lower part of the skirt has an annular outwardly extending resilient sealing means thereon. In the lowermost position of the platform, the annular sealing means is in interference contact with the intermediate cylindrical sealing portion of the sleeve bore, forming a circumferential seal therealong, and the lugs are in contact with the upper portion of the sleeve bore. The platform also has an elongated, depending, threaded central stem. The handwheel is rotably mounted at the lower end of the sleeve and has a threaded stem extending axially upwardly in threaded engagement with the platform stem so that rotation of the handwheel relative the sleeve and platform provides axial movement of the platform within the bore of the sleeve. Thus, the package has a vaportight lower seal when the elevating platform is in its lowermost position and concurrent capability of axial elevating platform movement within the sleeve.

DETAILED DESCRIPTION OF THE INVENTION

Figure 1:
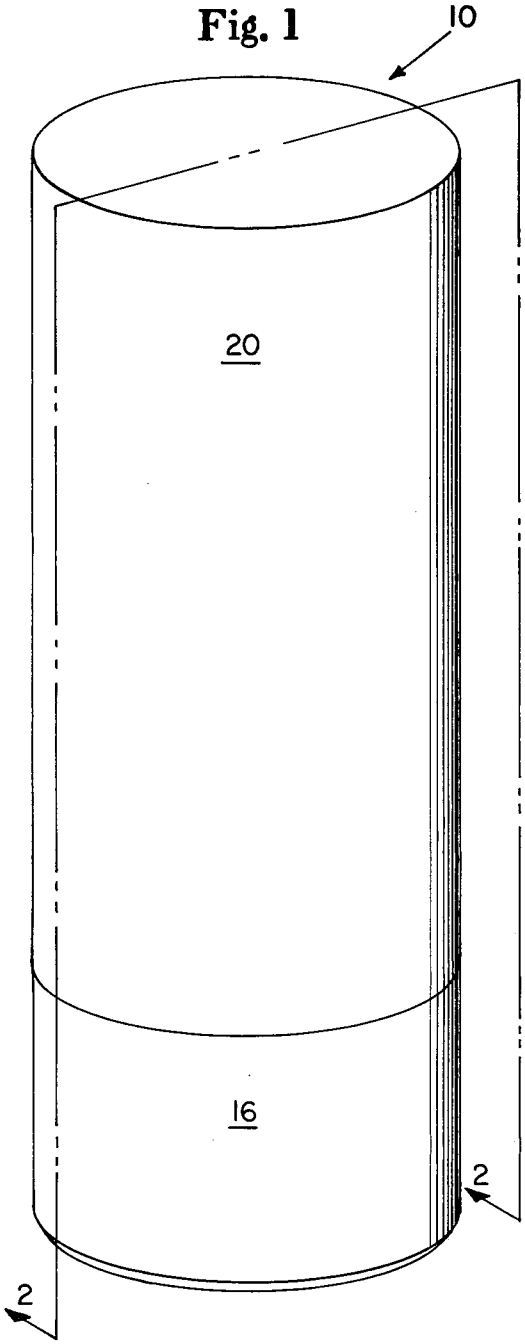
FIG. 1 is a perspective view of a package for a stick antiperspirant and/or deodorant product constructed in accordance with one aspect of the present invention.

While the specification concludes with claims particularly pointing out and distinctly claiming the subject matter regarded as forming the present invention, it is believed the invention will be better understood from the following details and description, which when taken in conjunction with the annexed drawings describes, discloses, illustrates and shows a preferred embodiment or modification of the present invention and what is presently considered and believed to be the best mode of practicing the principles thereof. Other embodiments or modifications may be suggested to those having the benefit of the teachings therein, and such other embodiments or modifications are intended to be reserved especially as they fall within the scope and spirit of the subjoined claims.

With reference now to the drawings, wherein like reference characters are utilized for like parts throughout the several views, there is shown and illustrated in FIGS. 1–6 an easily opened and reclosable vapor tight package designated generally by the reference character 10 especially suitable as a dispensing package for a stick form anti-perspirant and/or deodorant product. The package 10 comprises a body or sleeve 12, an elevating platform 14 slidably disposed therein, an operating handwheel 16 rotatably carried at one end portion of the sleeve 12, an elevating stem or screw member 18 carried by the handwheel member 16 for rotation therewith, and a tall cover or cap 20 removably, sealably carried by the handwheel member 16 and, together therewith, enclosing the body or sleeve 12 and the elevating mechanism, within a positively sealed vapor tight barrier or case which, in the closed configuration protects the product from drying and deterioration through loss of volatile components and, simultaneously, prevents inadvertent operation of the elevating mechanism when the cover or cap 20 is in place.

Figure 7:
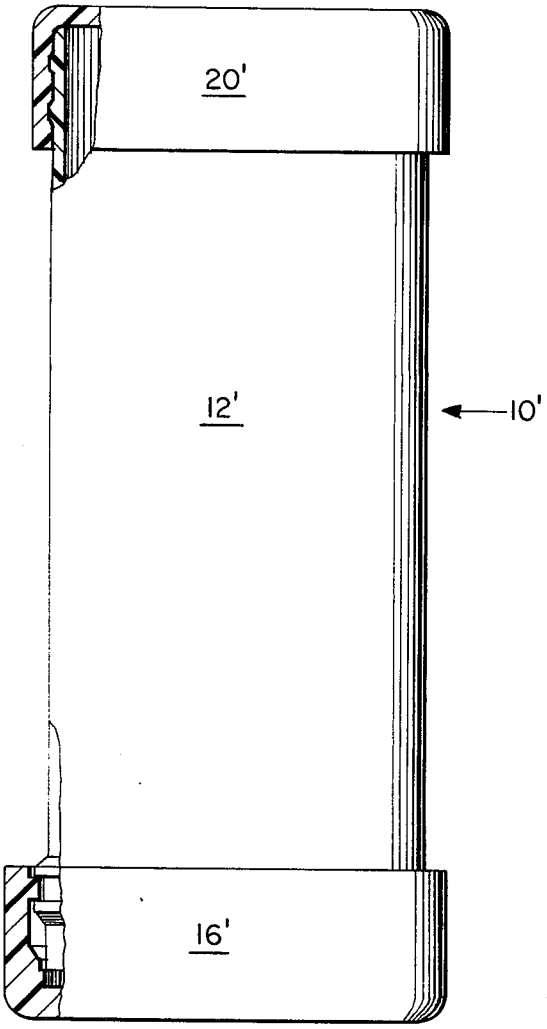
FIG. 7 is an elevational view, partly broken away and sectioned, of another embodiment of the present invention.

While the illustrated embodiment of FIGS. 1–6 shows the use of a tall cap 20, it will be understood that a short cap 20' could be substituted. This could be attached by threaded engagement with the exterior of the applicating (upper) end of the sleeve 12', as illustrated in FIG. 7. Thus, the short cap 20' would provide a vaportight seal at the upper end of the package 10' and a lower seal, to be described, between the elevating platform and sleeve seals the lower end of the package 10'. Due to the use of considerably less plastic in the short cap, substantial cost savings are possible with this embodiment while still resulting in a sealed package; however, inadvertent operation of the elevating mechanism could occur.

Returning now to the embodiment of FIGS. 1–6, each of the component parts and elements of the package are preferably injection molded of polypropylene. The body or sleeve 12 is of generally cylindrical configuration having a bore 22 within which the elevating platform 14 slides and within which the elevating mechanism and the product are generally contained, the product being progressively extended outwardly and exposed through a generally open and unobstructed mouth opening 24 provided at the upper end portion of the bore 22. As shown in solid lines in FIG. 2, the elevator platform is in its lowermost position.

Figure 2:
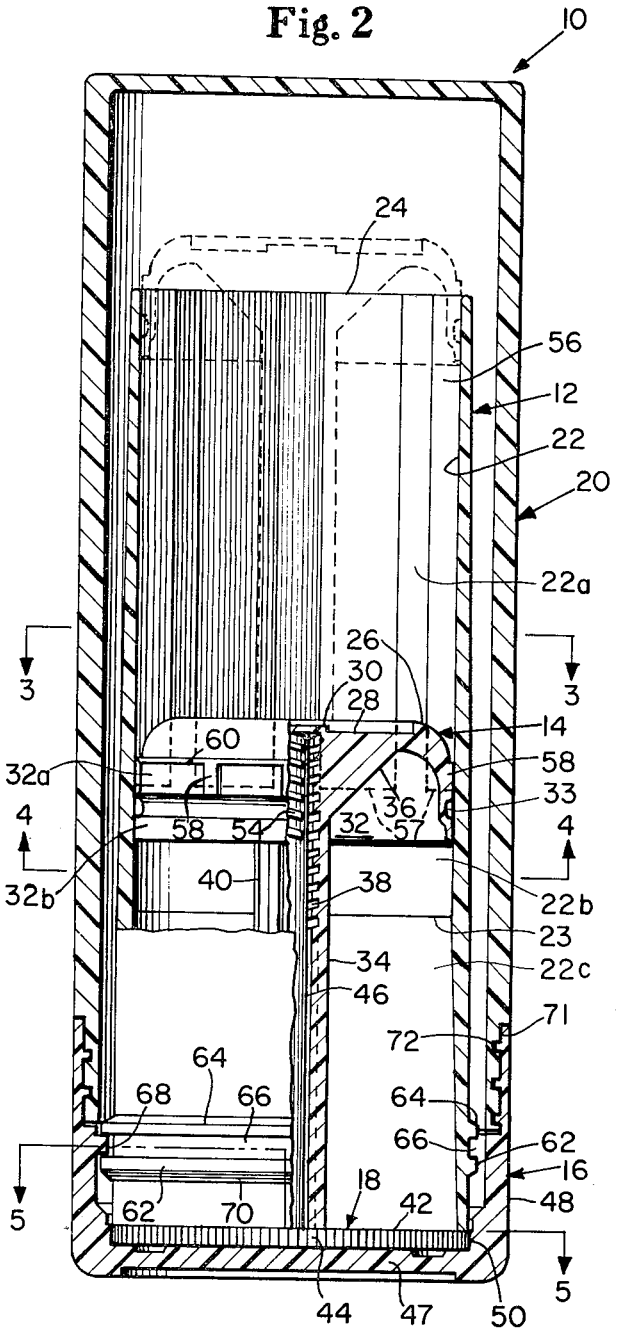
FIG. 2 is an elevational cross-sectional view of the package of FIG. 1 taken along line 2—2 of FIG. 1, with portions of the package shown unsectioned for clarity.
Figure 3:
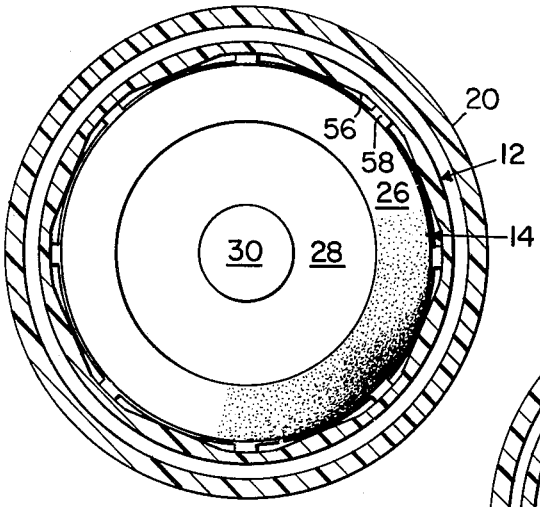
FIG. 3 is an enlarged cross-sectional plan view taken along line 3—3 of FIG. 2.
Figure 4:
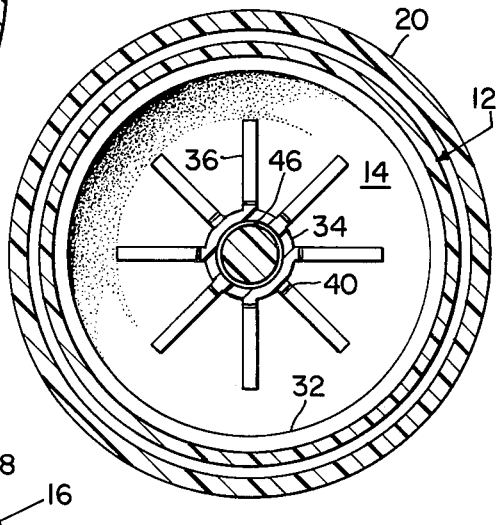
FIG. 4 is an enlarged cross-sectional plan view taken along line 4—4 of FIG. 2.
Figure 5:
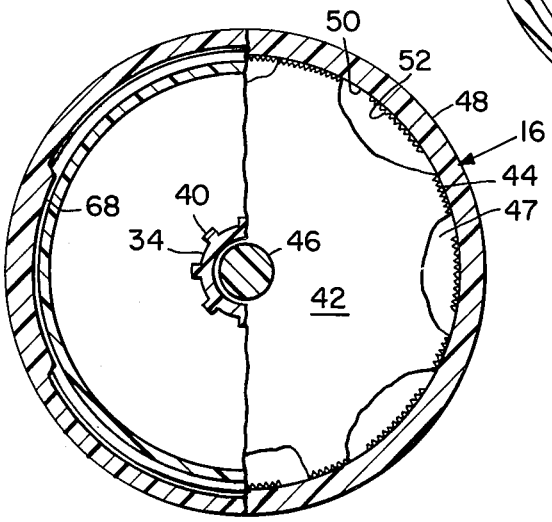
FIG. 5 is an enlarged cross-sectional plan view taken along line 5—5 of FIG. 2, with portions broken away to illustrate the underlying structure.
Figure 6:
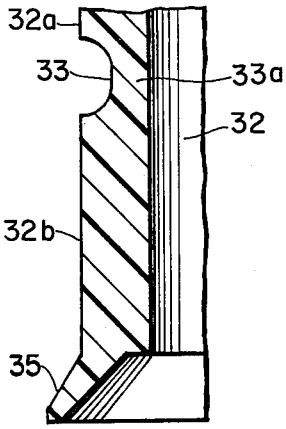
FIG. 6 is a greatly enlarged, fragmentary section of the skirt of the elevating platform of the embodiment of FIGS. 1–5.

The elevating mechanism, upon clockwise rotation of the handwheel member 16 relative the body or sleeve 12 advances the elevating platform 14 together with the stick product carried thereby along the bore 22 of the body or sleeve 12 toward the mouth opening 24, i.e., upwardly in FIG. 2. Conversely, counterclockwise rotation of the handwheel member 16 relative the body or sleeve 12 retracts the elevating mechanism, moving the elevating platform 14 within the body or sleeve 12 generally away from the open mouth 24 thereof and, if the product is affixed to the elevating platform 14, retracts the stick product into the body or sleeve 12.

The elevating platform 14 is a generally mushroom shaped configuration having a generally domed upper product-supporting surface 26 provided with a generally circular bounterbore 28 and a generally circular central dimple 30. If desired, the counterbore 28 can be made dovetailed in configuration by forming its sidewalls at an included angle of less than 90° to aid in locking the stick product in place. Further, the elevating platform 14 comprises a depending peripheral skirt 32, and elongated depending central stem portion 34 and a plurality of generally radiating supporting ribs or gussets 36 extending at least between the product supporting face portion 26 and the elongated depending stem 34. Yet further, the depending stem portion 34 is provided with an internal longitudinally extending female thread 38. The internal female threads 38 extend entirely longitudinally of the stem 34. Additionally, vestiges of the ribs 36 are extended along the perimeter of the stem portion 34 throughout the longitudinally extent thereof, defining longitudinally extending radiating ribs 40 therealong.

The skirt 32 of the platform 14 has an annular relief 33 molded therein intermediate upper part 32*a* and lower part 32*b* of the skirt 32. As shown most clearly in FIG. 6, the relief 33 creates a thinned section 33*a* which permits limited flexibility of the lower part 32*b* independent of the balance of the platform 14. If the package is to be used with a tall cap only, the relief 33 can be omitted, if desired. At the bottom of lower part 32*b* an annular outwardly extending resilient sealing means is provided. As illustrated the sealing means comprises a diagonally projecting flange 35.

The elevating screw 18, as heretofore pointed out, is mounted for rotation with the handwheel 16 and for rotation relative the platform 14 as well as providing longitudinal movement of the platform 14 relative thereto. The elevating screw 18 comprises a generally disc-like base 42 provided with serrations 44 extending peripherally therearound and an elongated post portion 46 extending axially therefrom. The handwheel 16 is of generally cup-shaped configuration comprising a generally circular end portion 47 and a generally annular sidewall portion 48. Internally of the sidewall portion 48 generally adjacent the end wall portion 47, the handwheel 16 comprises a generally inwardly directed annular shoulder portion 50 provided, on its interior surface, with internally directed groups of serrations 52 which mate with the serrations 44 extending around the periphery of the elevating screw base portion 42 to preclude relative rotation therebetween so that the elevating screw 18 will rotate with the handwheel 16. For example, the serrations 44 may number 144 extending entirely around the periphery of the base portion 42 of the elevating screw 18 while the serrations 52 may number only 60, being provided in groups of 10 serrations spaced apart at 6 places around the interior of the shoulder 50, centered 60° apart.

The post 46 of the elevating screw 18 may, throughout the major extent of its length, be of generally circular cross section and a clearance fit within the internal female threads 38 of the stem portion 34 of the platform 14. At the distal end, the post portion 46 may be provided with a short length of external, interrupted thread segments 54 which mate with the internal, continuous female threads 38 on the stem portion 34 of the platform 14 so that relative rotation of the elevating screw 18 relative the platform 14 raises and lowers the elevating platform 14 relative the elevating screw 18. The length of the post 46 of the elevating screw 18 relative the length of the threads 38 of the stem 34 of the platform 14 may be selected such that the domed product supporting surface 26 of the platform 14 may be extended outwardly of the bore 22 of the sleeve or body 12 to its uppermost position, as shown in dotted lines in FIG. 2, so that substantially all of the product may be dispensed. The external thread segments 54 and internal threads 38 may be lefthanded threads such that clockwise rotation of the handwheel 16 provides extension of the platform 14 relative the elevating screw 18 and, thereby, extension of the product outwardly through the mouth 24 of the sleeve or body 12.

The above-described arrangement employing an internally threaded stem portion 38 of platform 14 and externally threaded elevating screw 18 is an effective cost saving measure. It permits the conservation of material in the elevating platform 14 by the use of support ribs or gussets 36 instead of thick wall sections, without requiring the package 10 to be lengthened to accommodate the gussets 36. If the arrangement was reversed, i.e. the stem portion 38 was externally threaded and elevating screw 18 was internally threaded, the gussets 36 would prevent threaded engagement throughout their height and the entire package 10 would have to be lengthened to compensate for it if the same length of platform 14 movement is to be maintained.

In order to prevent the platform 14 from rotating relative the body or sleeve 12 so that rotation of the handwheel 16 assures relative rotation between the elevating screw 18 and the platform 14 and movement of the platform 14 longitudinal of the body or sleeve 12, the upper portion 22*a* of bore 22 of the body or sleeve 12 is provided with at least one, but preferably a plurality, such as eight, chordal flats 56 which extend longitudinally from mouth opening 24 to locations 57 spaced therefrom by a distance approximating that of the range of movement of the platform 14. Thus, locations 57 are adjacent upper part 32*a* of elevating platform 14 when it is in its lowermost position. In addition, the periphery of the platform 14 along upper part 32*a* is provided with a plurality, such as eight, mating externally extending ribs or lugs 58 which are adopted to engage the upper portion 22*a* of bore 22 of the body or sleeve 12 between the chordal flats 56. The reduced radial dimensions of the chordal flats 56 prevent the lugs 58 from moving sideways and therefore effectively preclude rotation of the platform 14 relative to the sleeve 12.

Adjacent the upper portion 22*a* of bore 22 is an intermediate portion 22*b* which is a smooth, generally cylindrical sealing surface extending between location 57 and the upper extremity 23 of lower portion 22*c* of the bore. When the platform 14 is in its lowermost position the sealing means of the platform 14, flange 35, is in interference contact with intermediate portion 22*b* to form a circumferential seal therebetween which is vapor tight to thereby prevent the loss of volatile components of the product contained in the package 10. For example, the outer diameter of flange 35 can exceed that of the intermediate portion 22*b* by about 0.25 mm for this purpose when the parts are made of polypropylene. Although the lower portion 22*c* can be cylindrical, desirably it should taper outwardly to an unobstructed enlarged diameter as it approaches the lower end of bore 22. This unobstucted portion 22*c* of bore 22 is adapted to form a lead-in surface for the platform 14 in assembling the package.

In addition, the platform 14 may be provided with a generally annular outwardly extending resilient lip 60 which may be deformed by engagement against the chordal flats 56 to provide a barrier about the platform 14 within the body or sleeve 12 and enable the product stick to be molded in place, or if previously formed, to be glued or adhered thereto, as by a hotmelt, or the like, while yet precluding such molten or adhering substance from leaking past the platform 14. If a hot substance is used for molding in place or adhering a preformed stick product to the platform 14, it is desirable to have an annular recess (not shown) molded into the top surface of the platform 14 to permit expansion of the central area of platform 14 without distortion. Also in this case it may be desirable to make the topwall of the platform 14 thicker and eliminate the gussets 36 to prevent rippling of the support surface 26 when heated. Thus, the planar configuration of the platform support surface, which is important in achieving a bond which will resist forces applied to the side of the stick in use, can be maintained.

In order to rotatably mount the handwheel 16 with the body or sleeve 12, a pair of annular ribs 62 and 64 may be provided circumferentially surrounding the exterior of the body or sleeve 12 adjacent the end portion thereof opposite that containing the mouth opening 24. The annular ribs 62 and 64 may be spaced apart, as shown, so as to define therebetween a groove or recess 66. The handwheel 16 may be provided with inwardly extending rib segments 68 which engage between the ribs 62 and 64 of the body or sleeve 12 so as to retain the handwheel 16 axially relative the body or sleeve 12 while rotatable thereon. The ribs 62 and 64 and, particularly the rib 62, may be chamfered or sloped on a surface 70 thereof opposite the groove 66 so that the rib segment 68 may be cammed outwardly thereby during assembly. For example, three ribs 68 may be provided based upon 120° centers. The elevating screw member 18 may be held in position between the end wall 47 of the handwheel 16 and the end of the body or sleeve 12, as shown. Finally, the cover or cap 20 and the handwheel 16 may be provided with mating screw threads 71 and 72 for providing a vapor-tight seal between the handwheel 16 and the tall cover or cap 20.

While the invention has been described, disclosed, illustrated and shown in terms of an embodiment or modification which it has assumed in practice, such other embodiments or modifications as may be suggested to those having the benefit of the teachings herein are intended to be expressly reserved especially as they fall within the scope and breadth of the claims here appended.

What is claimed is:

1. An elevating dispensing package for a stick form product, said package comprising:

an elongated sleeve of molded plastic and having a bore extending therethrough, the upper end of which defines a open mouth, said bore being generally circular in cross section with an upper portion thereof adjacent said mouth provided with at least one lengthwise extending chordal surface which terminates at a location spaced from the mouth of said bore by a distance approximating the length of the range of elevating movement of said package, a smooth, generally cylindrical, intermediate sealing portion and an unobstructed lower portion extending to the lower end of said bore;

an elevating platform of molded plastic slidably disposed within said sleeve bore and adapted for loading into said sleeve through the unobstructed lower portion thereof and to be moved from a lowermost position to an uppermost position therewithin, the platform comprising a product-support surface of generally circular conformation, a depending peripheral skirt, and an elongated, depending, threaded central stem, the upper part of said skirt being provided with lug means thereon to coact with the chordal surface of the upper portion of said sleeve bore to prevent relative rotation therebetween, said platform having a diameter across said lug means which is substantially similar to that of said upper portion and of said sealing portion of the bore of the sleeve to facilitate said loading, the lower part of said skirt having an annular outwardly extending, resilient sealing means associated therewith, the lug means on the upper part of said skirt and the resilient sealing means on the lower part of the skirt being separated by a finite distance, said elevating platform in its lowermost position having said annular sealing means in interference contact with the intermediate cylindrical sealing portion of the sleeve bore to form a circumferential seal between said elevating platform and said sleeve bore and simultaneously having said lug means in contact with the upper portion of said sleeve bore; and a handwheel rotatably mounted at the lower end of said sleeve, said handwheel having a threaded stem extending axially upwardly therefrom and in threaded engagement with the depending central stem of said elevating platform without extending through said product support surface, so that rotation of said handwheel relative said sleeve and elevating platform provides axial movement of said elevating platform within said sleeve bore without the threaded stem projecting into said product, whereby said package has a vaportight lower seal when the elevating platform is in its lowermost position and the concurrent capability of axial elevating platform movement within said sleeve.

2. The dispensing package of claim 1 in which said peripheral skirt of said elevating platform is essentially tubular and is provided with an annular relief of reduced wall thickness intermediate the upper and lower portions thereof permitting limited flexibility of the annular sealing means independent of the balance of said elevating platform.

* * * * *